United States Patent [19]

Müller et al.

[11] 4,418,672

[45] Dec. 6, 1983

[54] FUEL SUPPLY SYSTEM

[75] Inventors: Klaus Müller, Tamm; Franz Rieger, Aalen; Ernst Linder, Mühlacker, all of Fed. Rep. of Germany

[73] Assignee: Robert Bosch GmbH, Stuttgart, Fed. Rep. of Germany

[21] Appl. No.: 241,332

[22] Filed: Mar. 6, 1981

[30] Foreign Application Priority Data

Mar. 6, 1980 [DE] Fed. Rep. of Germany ..... 3008618

[51] Int. Cl.[3] ..... F01N 3/15

[52] U.S. Cl. ..... 123/478; 123/489; 123/492; 60/276; 239/102

[58] Field of Search ..... 123/440, 472, 478, 492, 123/489, 590, 780; 60/276, 285; 239/4, 102

[56] References Cited

U.S. PATENT DOCUMENTS

| | | | |
|---|---|---|---|
| 3,835,819 | 9/1974 | Anderson | 123/480 |
| 3,973,529 | 8/1976 | Wessel et al. | 123/489 |
| 4,023,358 | 5/1977 | Maurer et al. | 60/277 |
| 4,107,921 | 8/1978 | Iizuka | 123/489 |
| 4,165,610 | 8/1979 | Iizuka et al. | 123/489 |
| 4,166,577 | 9/1979 | Elwell | 239/102 |
| 4,202,295 | 5/1980 | Kondo et al. | 123/492 |
| 4,212,066 | 7/1980 | Carp et al. | 123/489 |
| 4,307,838 | 12/1981 | Martin | 239/102 |

FOREIGN PATENT DOCUMENTS

| | | | |
|---|---|---|---|
| 966380 | 4/1975 | Canada | 123/472 |

*Primary Examiner*—Craig R. Feinberg
*Attorney, Agent, or Firm*—Edwin E. Greigg

[57] ABSTRACT

A fuel supply system for mixture-compressing internal combustion engine with externally-supplied ignition is proposed, which serves to form the most optimal possible fuel-air mixture. The fuel supply system includes a primary mixture formation unit disposed in the intake manifold and at least one ultrasonic atomizer nozzle in the intake manifold, for the purpose of correcting the fuel-air mixture by means of supplementary fuel, downstream of the primary mixture unit or in each individual intake tube. The ultrasonic atomizer nozzles are triggered, with the interposition of an electronic control device, in accordance with operating characteristics of the engine, as well as the exhaust composition, and they permit the supply of finely prepared supplementary fuel for the purpose of regulating the fuel-air mixture to a predetermined λ value; of compensating for non-uniform distribution, and of enrichment of the mixture in the case of warm-up, full load and acceleration, as well as of idling regulation.

6 Claims, 4 Drawing Figures

FUEL SUPPLY SYSTEM

BACKGROUND OF THE INVENTION

The invention is based on a fuel supply system of the general type described hereafter. A fuel injection system is already known in which fuel injection valves serve to provide the supplementary mixture. However, in such a system, there is the disadvantage, especially at relatively low fuel injection pressures, that the supplementary fuel which is injected is not atomized sufficiently finely, and the course of combustion in the cylinders of the engine is accordingly not optimal. It is also already known to use ultrasonic atomizer nozzles for the purpose of atomizing the fuel, but in that case, the applicability of the system is very limited, because the maximum atomization output is approximately 2.5 liters per hour.

OBJECT AND SUMMARY OF THE INVENTION

The fuel supply system according to the invention has the advantage over the prior art that a simple mixture supply to the engine is made possible by means of a primary mixture formation unit, and because the supplementary mixture formation unit is provided with at least one ultrasonic atomizer nozzle, a correction of the fuel-air mixture can be made while taking into consideration the non-uniform distribution of fuel to the various cylinders, the desired fuel-air ratio λ, and enrichment in the case of warming up, full load, and acceleration. Furthermore, this supplementary mixture formation unit can be utilized for the purpose of regulating idling.

As a result of the characteristics disclosed in the invention, advantageous modifications of and improvements to the fuel supply system disclosed therein can be attained. It is particularly advantageous that one ultrasonic atomizer nozzle is disposed in each individual intake tube of one cylinder, which is triggerable by one corresponding exhaust sensor in the associated individual exhaust line, the triggering time of the individual ultrasonic atomizer nozzle being capable of being prolonged in an additive fashion in the case of warming up, full load and acceleration.

A further advantageous provision is the disposition of the mouth of the ultrasonic atomizer nozzles in the region of a protrusion of the intake tube, along which liquid fuel can then flow from the primary mixture formation unit.

The invention will be better understood and further objects and advantages thereof will become more apparent from the unsuing detailed description of preferred embodiments taken in conjunction with the drawings.

DESCRIPTION OF THE PREFERRED EMBODIMENTS

Figure 1:
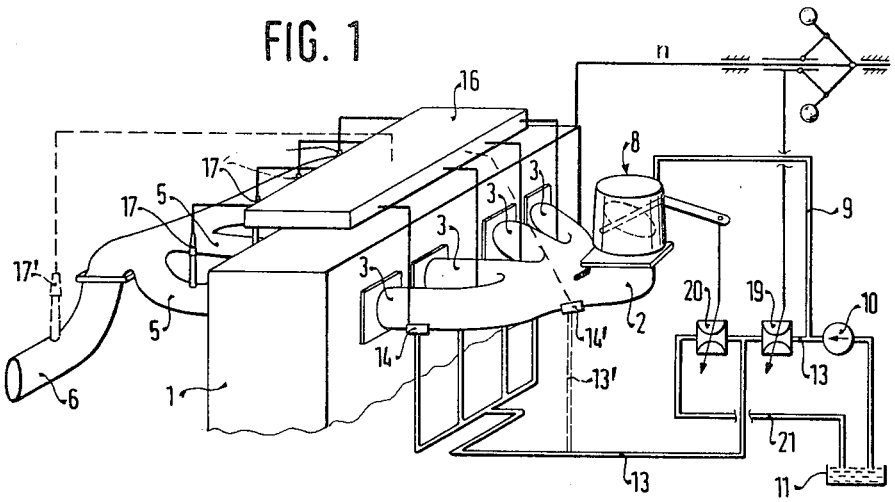
FIG. 1 shows schematically an internal combustion engine having a fuel supply system in accordance with the invention.

In FIG. 1, a mixture-compressing internal combustion engine having externally-supplied ignition is indicated by reference numeral 1. Individual intake tubes 3 lead to the cylinders of this engine, branching off from an intake manifold 2. On the outlet side of the individual cylinders, individual exhaust lines 5 are provided which discharge into an exhaust minifold line 6. A primary mixture formation unit 8 is provided in the intake manifold 2, which may be embodied for example as a carbureator or as a fuel injection system having an injection valve, and which is supplied with fuel via a primary fuel supply line 9. Fuel is supplied into the primary fuel supply line 9 by a fuel supply pump 10, which aspirates the fuel from a fuel container 11. A supplementary fuel line 13 branches off from the primary fuel supply line 9, serving to supply fuel to a supplementary mixture formation unit having ultrasonic atomizer nozzles 14 and 14'. The structure and mode of operation of an ultrasonic atomizer nozzle will be discussed below with the aid of FIG. 4. The supplementary fuel line may lead, as indicated by reference numeral 13' and shown in broken lines, to an ultrasonic atomizer nozzle 14', which discharges into the intake manifold 2 downwstream of the primary mixture formation unit 8. The ultrasonic atomizer nozzle 14', is triggerable by a known electronic control device 16, into which the measurement valves of operating characteristics of the engine, such as load, rpm, coolant or aspirated air temperature, exhaust composition, and similar characteristics, converted into electric variables, can be fed. A so-called oxygen sensor or a boundary current sensor may serve as the exhaust sensor 17, or 17'. The exhaust sensor 17' indicated by broken lines and disposed in the exhaust manifold line 6, can serve to trigger the ultrasonic atomizer nozzle 14'. Because of the maximum atomizer output of the ultrasonic atomizer 14, 14', which is approximately 2.5 liters per hour, the use of the ultrasonic atomizer nozzle 14, 14' is efficient only for the purpose of correcting the fuel-air mixture or for enriching the mixture in the case of warm-up, full load and acceleration. The enrichment of the fuel-air mixture during warm-up, full loan and acceleration is effected in an advantageous manner by means of the additive prolongation of the triggering time of ultrasonic atomizer nozzle 14'.

In a different exemplary embodiment of the invention, an ultrasonic atomizer nozzle 14 is disposed in each individual intake tube 3, communicating with the supplementary fuel line 13 and being individually triggerable by the electronic control device 16. With the aid of performance graph, which also takes into consideration the non-uniform distribution to the individual cylinders of the engine, and which is stored in memory in the electronic control device 16, the individual ultrasonic atomizer nozzle 14 are triggered in such a manner that the non-uniform distribution of the mixture to the individual cylinders is compensated for as well. This fundamental triggering time is additively superimposed with a further triggering time for the purpose of enriching the mixture during warm-up, full load and acceleration.

The regulation of the fuel-air ratio λ to $\lambda=1$ can be effected in this exemplary embodiment in the following manner: the triggering of the individual ultrasonic atomizer nozzle 14 is effected in accordance with signals from the oxygen sensor 17' in the exhaust manifold line 6, and with the evaluation of the performance graph stored in memory in the electronic control device 16, a correction the triggering times of the individual ultrasonic atomizer nozzles 14 is effected for the purpose of compensation for the non-uniform distribution of the mixture to the individual cylinders. In a further exemplary embodiment, the ultrasonic atomizer nozzles 14 disposed in each individual intake tube 3 are triggered via the electronic control device 16 by one exhaust sensor 17 associated with each ultrasonic atomizer nozzle 14, the exhaust sensor 17 being disposed in each associated individual exhaust line 5. The fuel-air mixture can thus be varied for each cylinder of the engine individually, in such a way that the desired fuel-air mixture can be influenced by influencing the triggering time of each individual ultrasonic atomizer nozzle 14. Thus, the non-uniform mixture distribution to the individual cylinders is compensated for automatically. In the case of warm-up, full load and acceleration, the triggering signal of the ultrasonic atomizer nozzle 14 can be additively superimposed in order to enrich the mixture.

In all the exemplary embodiments, influence can be exerted on the quantity of fuel atomized via the ultrasonic atomizer nozzles 14, 14' by providing the supplementary fuel line 13 with a variable pressure divider, embodied by a throttle restriction 19 and 20, wherein the fuel pressure is located between the two throttle restrictions 19, 20 at the ultrasonic atomizer nozzles 14, 14', and the throttle restriction 19 is disposed upstream of the throttle restriction 20. Downstream of the throttle restriction 20, a return flow line 21 is provided by way of which fuel can flow back to the fuel container 11. The cross-section of the throttle restriction 19 may be variable in accordance with the rpm, shown as "n", and the cross section of the throttle restriction 20 can be variable in accordance with the load (throttle valve position).

Figure 2:
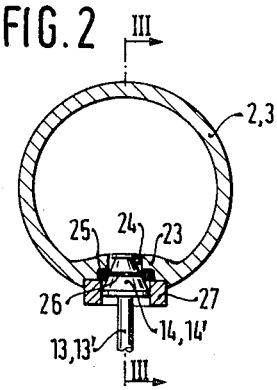
FIG. 2 is a cross-section taken through an intake ture having an ultrasonic atomizer nozzle.
Figure 3:
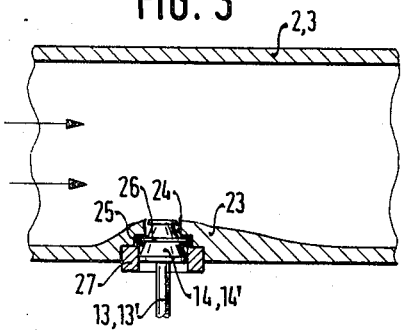
FIG. 3 is a longitudinal section taken along the line III—III of FIG. 2.

In FIGS. 2 and 3, an advantageous disposition of the ultrasonic atomizer nozzles 14, 14' in the intake tube 2, 3 is shown. A protrusion 23 is provided here on the intake tube wall at which there are generally flows of liquid fuel along the wall downstream of the primary mixture formation unit 8. This protrusion 23 reduces the intake tube cross section so that as a result of the reduction of the static pressure in the mixture flow, the liquid fuel is drawn upward at the protrusion 23 and is atomized by the ultrasonic atomizer nozzle 14, 14' discharging into the intake tube 2, 3 in the protrusion 23. The ultrasonic atomizer nozzle 14, 14' is inserted into an opening 24 of the intake tube wall 2, 3 and is seated with an elastic rubber ring 25, which protrudes over a flange 26 of the ultrasonic atomizer nozzle 14, 14' on a step of the opening 24 and is pressed against this step by a fastening ring 27.

Figure 4:
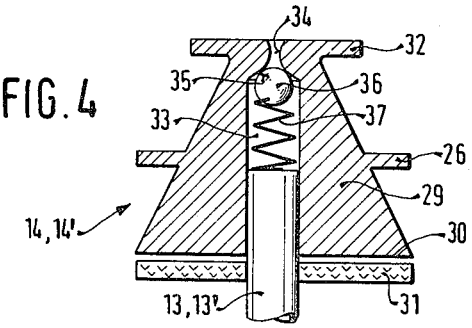
FIG. 4 is a section through an ultrasonic atomizer nozzle.

In FIG. 4, an ultrasonic atomizer nozzle 14, 14' is shown which has a frustoconically embodied oscillation amplifying body 29, which at its end 30 of larger diameter is provided with a piezo-ceramic disc 31 and at the other end is provided with an atomizer plate 32. A central flow channel 33 communicates with the supplementary fuel line 13, 13' and narrows toward the atomizer plate 32 to form a nozzle 34, with a valve seat 35 being formed in the transitional area between the flow channel 33 and the nozzle 34. A ball 36 serving as the movable valve element, which is guided in the flow channel 33, cooperates with this valve seat 35. The ball 36 could possibly be pressed by a weak spring 37 against the valve seat 35. The piezo-ceramic disc 31 is provided with electrical terminal contacts by way of which the electric connection with the electronic control device 16 is established.

If the piezo-ceramic disc 31 is excited then it executes radial oscillations, which being transmitted upon the oscillation amplifier body 29 cause the rims of the atomizer plate 32 to oscillate up and down and cause the ball 36 to lift from the valve seat 35. As a result, fuel can distribute itself via the nozzle 34 along the atomizer plate 32 and is atomized by the rims of the atomizer plate 32. If the excitation of the piezo-ceramic disc 31 is terminated, then the ball 36 is pressed by the fuel pressure or spring 37 against the valve seat 35, preventing the further flow of fuel out of the ultrasonic atomizer nozzle 14, 14'.

The ultrasonic atomizer nozzles 14, 14' may also serve the purpose of idling rpm regulation of the engine, in that when the rpm drops below a predetermined rpm during idling the ultrasonic atomizer nozzles 14, 14' are triggerable by the electronic control device 16 such that as a result of the increased feeding of fuel the rpm increases to the desired idling rpm.

The foregoing relates to preferred exemplary embodiments of the invention, it being understood that other embodiments and variants are possible within the spirit and scope of the invention, the latter being defined by the appended claims.

What is claimed and desired to be secured by Letters Patent of the United States is:

1. A fuel supply system for a mixture-compressing internal combustion plural cylinder engine having internally-supplied ignition, and including a primary mixture formation unit disposed in a common intake tube having branches leading to individual cylinders of said engine and at least one supplementary mixture formation unit also disposed in each of the branches thereof, characterized in that at least one ultrasonic atomizer nozzle serves as said supplementary mixture formation unit and is disposed in said intake tube branch downstream of said primary mixture formation unit, triggering of each of said ultrasonic atomizer nozzles is effected by programmable means stored in a memory of an electronic control device, said memory having stored therein a performance graph showing the non-uniform distribution of the mixture to the individual cylinders of said engine, and said engine further including individual exhaust manifold lines, and exhaust sensor means in each of said lines for detecting oxygen content in the exhaust gas, and for controlling said at least one ultrasonic atomizer nozzle via said electronic control device.

2. A fuel supply system as defined by claim 1, characterized in that triggering time of said ultrasonic atomizer nozzles can be additively prolonged for the purpose of the warm-up, full load, and acceleration enrichment of the fuel-air mixture.

3. A fuel supply system as defined by claim 1, characterized in that pressure of fuel delivered to said ultrasonic atomizer nozzle is variable in accordance with engine load and rpm.

4. A fuel supply system as defined by claim 1, in that each one of said intake tube branches has an inner wall area, said inner wall area further including means arranged to reduce a portion of the cross-section of said wall area and said ultrasonic atomizer disposed at said reduced portion of said wall area.

5. A fuel supply system as defined by claim 1, characterized in that said ultrasonic atomizer nozzle further includes a frustoconical oscillation amplification body provided with an axial bore, said bore having a spring loaded valve element arranged to cooperate with a valve seat therein and said body further including a piezo-ceramic disc at one end and an atomizer plate at another end.

6. A fuel supply system as defined by claim 1, characterized in that said ultrasonic atomizer nozzle is triggerable by said electronic control device in accordance with engine rpm so that when the rpm drops below a predetermined rpm, supplementary fuel can be delivered via the ultrasonic atomizer nozzle until the desired idling rpm has again been attained.

* * * * *